US010096305B2

(12) United States Patent
Brenna

(10) Patent No.: US 10,096,305 B2
(45) Date of Patent: Oct. 9, 2018

(54) MUSICAL INSTRUCTION AND METHODS OF NOTATING MUSIC RELATED THERETO

(71) Applicant: Joseph D. Brenna, Longmont, CO (US)

(72) Inventor: Joseph D. Brenna, Longmont, CO (US)

( * ) Notice: Subject to any disclaimer, the term of this patent is extended or adjusted under 35 U.S.C. 154(b) by 67 days.

(21) Appl. No.: 14/735,638

(22) Filed: Jun. 10, 2015

(65) Prior Publication Data

US 2015/0356958 A1 Dec. 10, 2015

Related U.S. Application Data

(60) Provisional application No. 62/010,299, filed on Jun. 10, 2014.

(51) Int. Cl.
*G10G 1/02* (2006.01)

(52) U.S. Cl.
CPC ..... *G10G 1/02* (2013.01)

(58) Field of Classification Search
CPC ..... G09B 15/00; G09B 15/003; G09B 15/02; G09B 15/08; G09B 15/006; G09B 19/00; G09B 11/04; G09B 15/001; G10G 1/02; G10G 1/00; G10H 2220/015; G10H 1/38
See application file for complete search history.

(56) References Cited

U.S. PATENT DOCUMENTS

2002/0050206 A1* 5/2002 MacCutcheon ..... G09B 15/023 84/477 R
2002/0178896 A1* 12/2002 George ..... G09B 15/026 84/477 R
2014/0260898 A1* 9/2014 Bales ..... G09B 15/026 84/433

* cited by examiner

*Primary Examiner* — Kimberly Lockett
(74) *Attorney, Agent, or Firm* — Richards Patent Law P.C.

(57) ABSTRACT

The present invention provides a method of notating music comprising the steps of providing a plurality of icons, wherein each icon comprises at least two characteristics selected from the group consisting of a shape, a symbol, and a color, and assigning each icon to a note of a plurality of notes of the chromatic scale. The plurality of notes includes notes that may be arranged into a plurality of chords. At least one characteristic of the icons of each of the notes of each chord is the same. The method further comprises the step of providing a musical notation comprising the plurality of icons.

20 Claims, 5 Drawing Sheets

MUSICAL INSTRUCTION AND METHODS OF NOTATING MUSIC RELATED THERETO

CROSS-REFERENCE TO RELATED APPLICATIONS

This application incorporates by reference and claims the benefit of priority to U.S. Provisional Application 62/010,299, filed on Jun. 10, 2014.

BACKGROUND OF THE INVENTION

The present subject matter relates generally to music instruction and methods of notating music.

For many people, playing a musical instrument is a popular pastime or activity. Learning to play a musical instrument, however, is not easy. Beginners particularly have trouble reading music and playing the corresponding notes. Some people may even seek musical instruction with the hope of improving their musical skills or even making a career in music performance.

The conventional method of music instruction involves reading some form of music notation, such as standard sheet music, guitar tablature, and/or scale and chord frames, and playing the corresponding notes on the musical instrument. As a musician progresses, it is important for the musician to learn more than just reading music, but to actually understand the relationships between notes, chords, and scales. This knowledge is the foundation of music theory, which helps musicians with many intermediate and advanced musical skills, including composition. For many music students, the relationships between notes, between the notes of chords and scales, and between written notes and the corresponding points on the instrument where the notes are produced are not immediately apparent in standard music instruction and/or notation.

Accordingly, there is a need for a musical instruction and method of notating music related thereto that allows for the visualization of relationships between notes, chords, and scales and between the notes of the written notation and the location on the playing surface of an instrument.

BRIEF SUMMARY OF THE INVENTION

To meet these needs and others, the present disclosure provides systems and methods for notating music using a unique set of icons that provide visual cues corresponding to relationships between notes, chords, and scales. The systems and methods provide a new manner in which notation is written using specially developed interrelated icons and further provide new mechanisms for marking an instrument with the icons corresponding to the notes, chords, and scales. The icons are developed to instantly visually communicate the relationships between notes, chords, and scales using combinations of shapes, symbols, and colors integrated within each icon. Although the primary examples provided herein incorporate shapes, symbols, and colors to communicate at least three relationships between notes, it is understood that based on the disclosures provided herein, those with ordinary skill in the art will understand that some of the advantages and objectives of the present subject matter can be achieved using a greater or lesser number of characteristics (i.e., shapes, symbols, colors, etc.) to communicate a greater or lesser number of relationships between notes.

According to one aspect of the present invention, a method of notating music comprises the steps of providing a plurality of icons, wherein each icon comprises at least two characteristics selected from the group consisting of a shape, a symbol, and a color, and assigning each icon to a note of a plurality of notes of the chromatic scale. The plurality of notes includes notes that may be arranged into a plurality of chords. At least one characteristic of the icons of each of the notes of each chord is the same. Each icon provides a unique color for each note, such that there is a one-to-one relationship between colors and notes. The method further comprises the step of providing a musical notation comprising the plurality of icons.

According to a further aspect, a musical instruction comprises a musical notation including a plurality of icons and a set of corresponding icons configured to be applied to a playing surface of an instrument where the corresponding note is produced. Each icon comprises a shape, a symbol, and a color, and each icon is assigned to a note of a plurality of notes of the chromatic scale. The plurality of notes includes notes that may be arranged into a plurality of four-note chords and notes that may be arranged into a plurality of three-note chords. One of the shape and the symbol of the icons of the notes of each four-note chord is the same, and one of the shape and the symbol of the icons of the notes of each three-note chord is the same.

According to a further aspect, a method of notating music comprises the steps of providing a plurality of icons, each icon including a shape, a symbol, and a color and assigning each icon to a note of a musical scale. The musical scale includes notes that may be arranged into a plurality of four-note chords and notes that may be arranged into a plurality of three-note chords. One of the shape, symbol, and color of the icons of the notes of each four-note chord is the same, and one of the shape, symbol, and color of the icons of the notes of each three-note chord is the same. The method further comprises the step of providing a musical notation comprising the plurality of icons.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The present disclosure provides a musical instruction including a plurality of icons representing a plurality of notes comprising the chromatic scale or Western tonal system of music. In one embodiment, each icon having a color, a shape, and a symbol represents each note of the plurality of notes. The color, shape, and symbol of the icons illustrate intervals, chords, and scales within musical notation and musical instruments of the present disclosure. The use of the icons within the musical notation and on the musical instrument creates a visual correlation between the notes as written and the exact locations on the instrument.

Figure 1A:
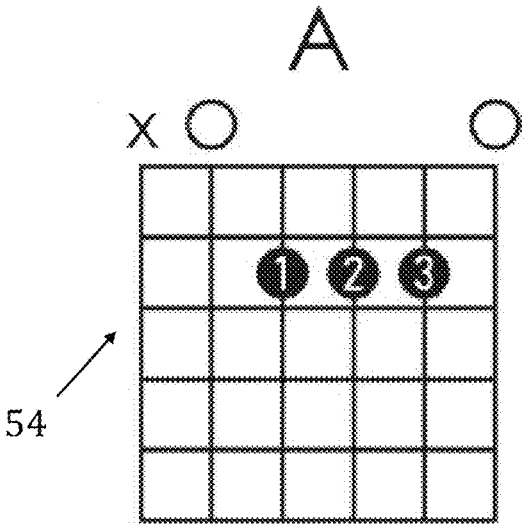
FIG. 1A is a standard chord frame.
Figure 1B:
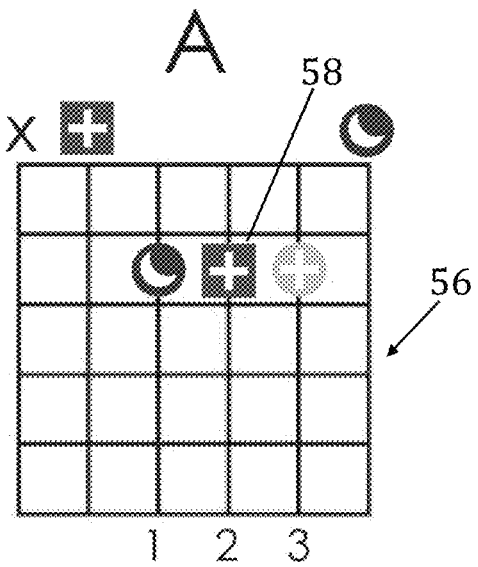
FIG. 1B is a chord frame including the icons of the present invention.
Figure 2A:
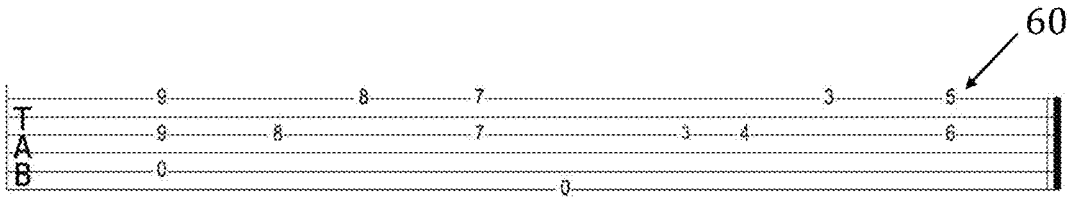
FIG. 2A is a standard guitar tablature.
Figure 2B:
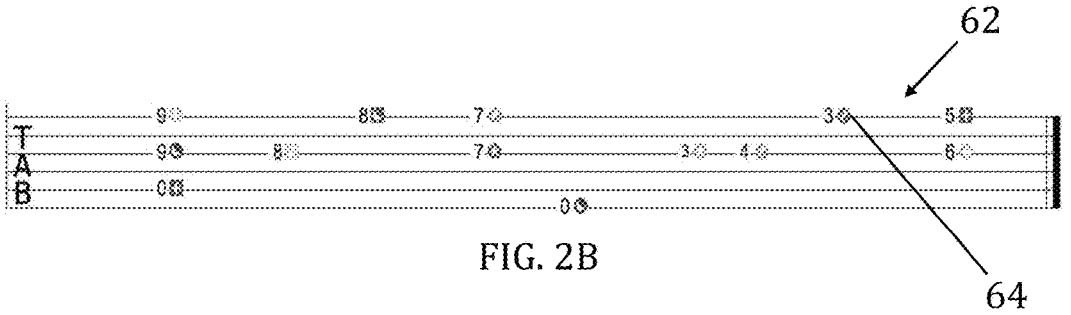
FIG. 2B is a guitar tablature including the icons of the present invention.

The icons may be incorporated into a variety of musical notation to identify and describe the note produced. For example, in standard notation, the icons may replace the notehead. In scale and chord frames, the icons may replace the dots or finger numberings that are commonly used. FIGS. 1A and 1B illustrate a standard chord frame 54 for the guitar chord A and a chord frame 56 for the guitar chord A including the icons 58 of the present disclosure, respectively. In guitar tablature, the icons may appear on the lines of the staff next to or in place of the numbers. FIGS. 2A and 2B illustrate a standard guitar tablature 60 and a guitar tablature 62 including the icons 64 of the present disclosure, respectively.

Figure 3:
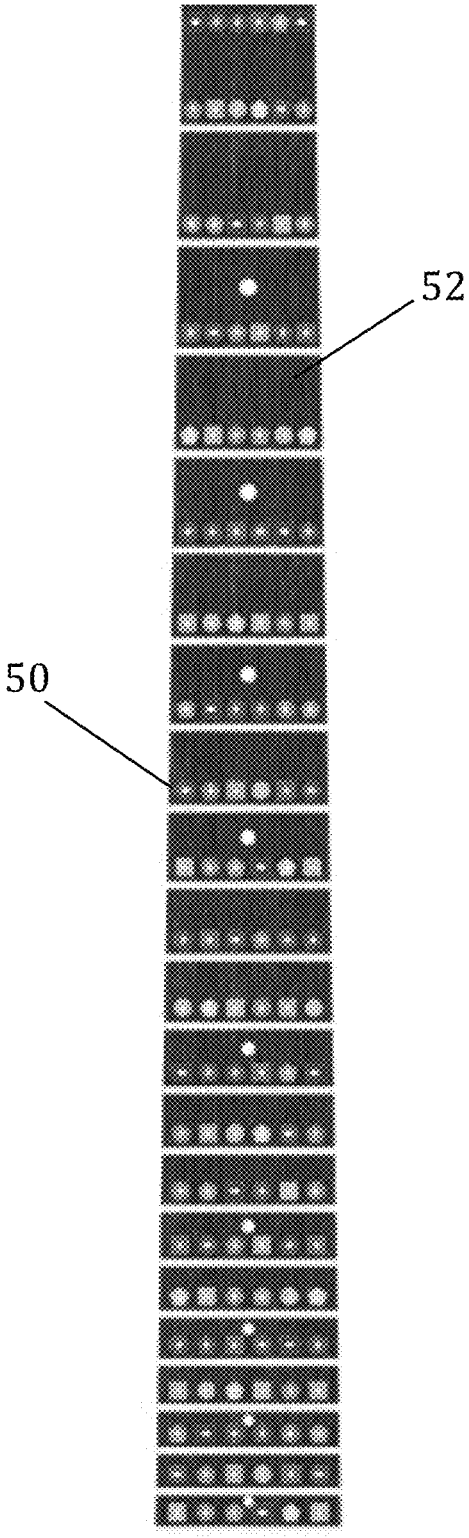
FIG. 3 is a guitar neck including the icons of the present invention.

Further, a set of the icons may be provided for application to the playing surface of an instrument. For example, a set of icons may be provides as stickers, decals, or any other permanent or removable graphic. In some instances, the icons may be built into the instrument from the start. Each icon of the set of icons may be disposed atop a place on the playing surface where the corresponding note is produced. Referring to FIG. 3, a set of icons 50 may be applied to the fretboard 52 of a guitar. In other embodiments, a set of icons 50 may be applied to the keys of a piano or keyboard, a steel-drum, or any other pitched instrument.

Figure 4:
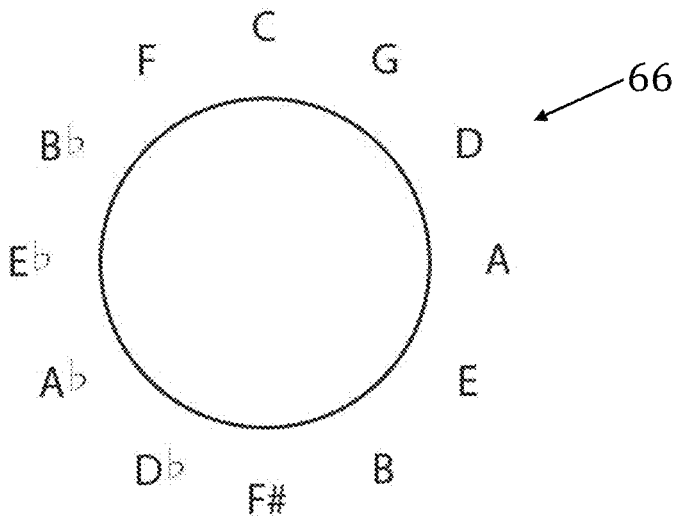
FIG. 4 is a diagram of a plurality of notes arranged in a circle of 5ths.
Figure 5:
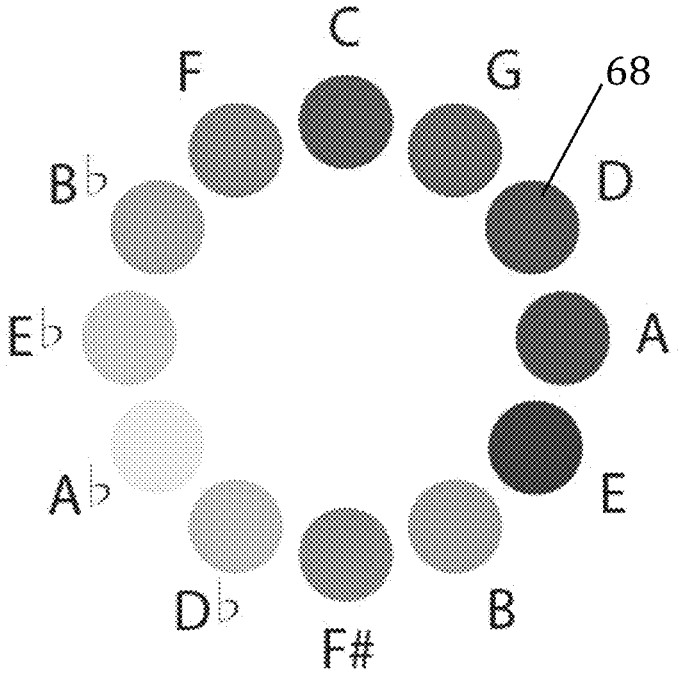
FIG. 5 is a diagram of a plurality of icons, each of which is associated with a note of the plurality of notes of FIG. 4.

In one example, to prepare a plurality of icons in accordance with the present disclosure, the notes of the chromatic scale are arranged in the form of the traditional circle of 5ths diagram 66 as shown in FIG. 4. The notes include C, G, D, A, E, B, F#, D♭, A♭, E♭, B♭, and F. Referring to FIG. 5, each icon 68 of a plurality of icons is arranged adjacent to the corresponding note. Each icon 68 has a color in accordance with a color wheel or color circle having twelve colors that is overlaid the arrangement of icons adjacent the notes of the circle of 5ths such that there is a one-to-one correlation between colors and notes. In the illustrated embodiment, each icon of the notes C, G, D, A, E, B, F#, D♭, A♭, E♭, B♭, and F has the color red, red-violet, violet, blue-violet, blue, blue-green, green, yellow-green, yellow, yellow-orange, orange, red-orange, and red color, respectively. In other embodiments, the color wheel may be rotated so that any color is assigned to the note C and the remaining notes are assigned colors, respectively. Further, the colors of the color wheel may progress clockwise or counterclockwise toward "hot" colors or "cool" colors as desired.

The icons of notes that are contiguous on the circle of 5ths diagram have colors that are contiguous on the color wheel. Intervals formed by pairs of notes are identified by fixed color relationships. For example, icons of notes that form the consonant intervals of the perfect 4th and perfect 5th in relation to a given note are immediately adjacent to the given note. Therefore the colors of the icons of the perfect 4th and perfect 5th are one color shade offset from the color of the icon of the given note and therefore have a similar hue. The perfect 4th and perfect 5th notes display the greatest color similarity to the color of the icon of the given note.

Similarly, the icon of the note that forms the dissonant interval of the tritone in relation to a given note is positioned opposite to the given note on the diagram shown in FIG. 5. The icon of the note that forms the dissonant interval is the complementary color, or the most dissimilar color hue, of the icon of the given note. The icons of other notes that form highly dissonant intervals in relation to the given note, such as the minor 2nd and major seventh, are one color shade offset from the color of the icon of the dissonant note. Therefore the minor 2nd and major seventh display highly dissimilar color hues to the color of the icon of the given note.

The plurality of notes includes notes that may be arranged into a plurality of four-note chords and a plurality of three-note chords. The shapes or symbols of the icons of notes of the chords may illustrate such relationships.

Figure 6:
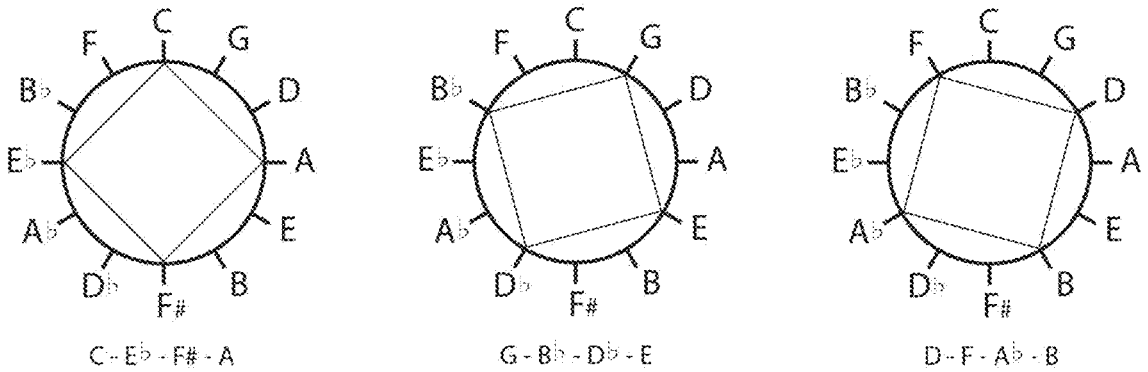
FIG. 6 is a plurality of four-note chords illustrated on the diagram of FIG. 4.
Figure 7:
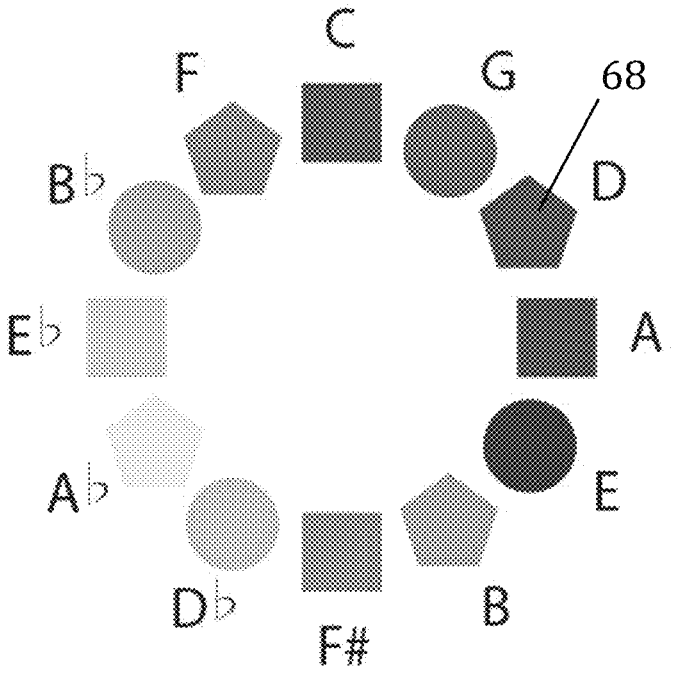
FIG. 7 is a diagram of a plurality of icons, each having a specific shape and each of which is associated with a note of the plurality of notes of FIG. 4.

The icons 68 of the present disclosure may comprise any shape such as a circle, a square, a hexagon, or the like. The notes of the chromatic scale may be arranged into a plurality of four-note chords such as the three diminished seventh chords. As shown in FIG. 6, the notes belonging to each of the three diminished seventh chords are diagramed by drawing squares inside of the circle of 5ths diagram. The icons of the notes of the three diminished seventh chords may have the same shape. For example, the shape of the icons of the chord C-E♭-F#-A, the chord G-B♭-D♭-E, and the chord D-F-A♭-B may be a square, a circle, and a hexagon, respectively, as illustrated in FIG. 7.

When viewed within the musical notation or on the playing surface of an instrument, the notes that comprise each diminished seventh chord are visually apparent by the matching shapes. A user may visually track the shapes and observe patterns formed by the notes that are used to play diminished seventh chords and diminished seventh arpeggios. Additionally, the notes of two diminished seventh chords form an 8-note diminished scale such that a user may visually track any combination of two diminished seventh chords by tracking any pair of icon shapes (such as squares and circles) to observe one of three 8-note diminished scales.

Figure 8:
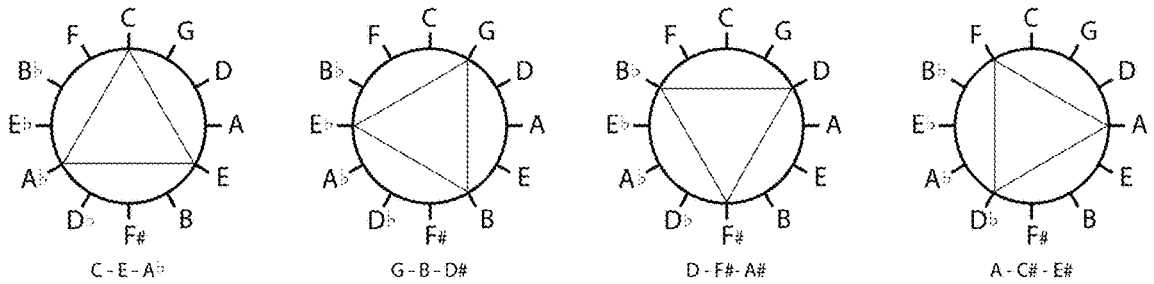
FIG. 8 is a plurality of three-note chords illustrated on the diagram of FIG. 4.
Figure 9:
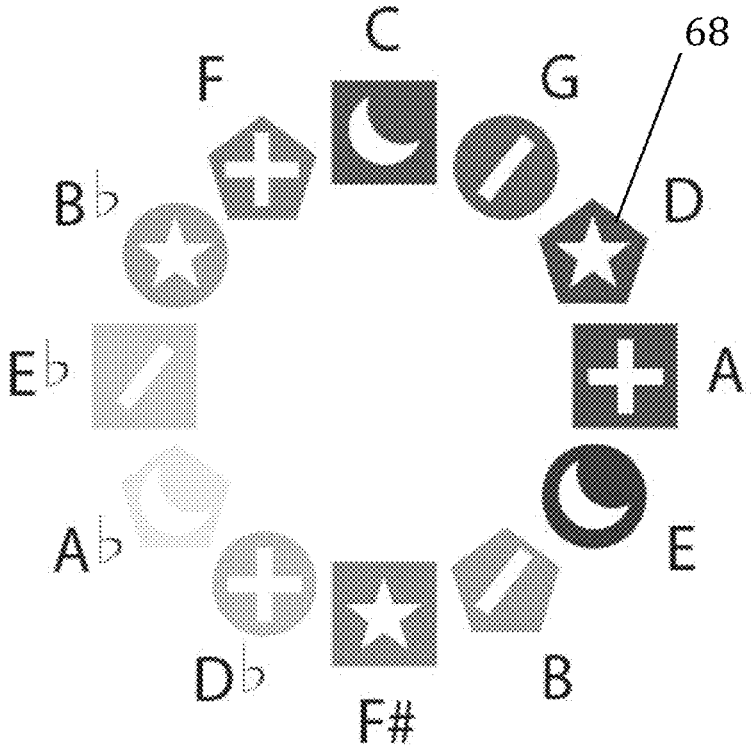
FIG. 9 is a diagram of a plurality of icons, each having a specific shape and symbol and each of which is associated with a note of the plurality of notes of FIG. 4.

The icons of the present disclosure may also comprise any symbol such as a crescent, a slash, a star, and a plus, or the like. The notes of the chromatic scale may be arranged into a plurality of three-note chords such as four augmented triads. As shown in FIG. 8, the notes belonging to each of the four augmented triads are diagramed by drawing equilateral triangles inside of the circle of 5ths diagram. The icons of the notes of the three diminished seventh chords may have the same symbol. For example, the icons of the chord A♭-C-E, the chord G-B-E♭, the chord D-F♯-B♭, and the chord A-D♭-F may include a crescent, a slash, a star, and a plus, respectively, as illustrated in FIG. 9.

When viewed within the musical notation or on the playing surface of an instrument, the notes that comprise each augmented triad are visually apparent by the matching symbols. A user may visually track the symbols and observe patterns formed by the notes that are used to play augmented triads and augmented arpeggios. Additionally, the notes of two augmented triads form a 6-note augmented scale such that a user may visually track a combination of two augmented triads by tracking any pair of non-consecutive icon symbols (such as crescents and stars, or slashes and plusses) to observe one of two 6-note augmented or whole tone scales.

In other embodiments, the symbols may be used to illustrate the relationship of the notes of the four-note chords and the shapes may be used to illustrate the relationships of the notes of the three-note chords. For example, icons of the four three-note chords may have shapes such as a square, a circle, a hexagon, and a star, and the icons of the three four-note chords may include symbols such as a crescent, a slash, and a plus.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A method of notating music comprising the steps of:

providing twelve unique icons, each icon including a unique combination of at least two visual identifiers, including a primary visual identifier and a secondary visual identifier;

wherein the primary visual identifier is one of a plurality of external shapes, one of a plurality of internal symbols, or one of a plurality of colors;

wherein the secondary visual identifier is one of the plurality of external shapes, one of the plurality of interior symbols, or one of the plurality of colors;

wherein when the primary visual identifier is one of the plurality of external shapes, the secondary visual identifier is one of the plurality of internal symbols or one of the plurality of colors;

wherein when the primary visual identifier is one of the plurality of internal symbols, the secondary visual identifier is one of the plurality of external shapes or one of the plurality of colors;

wherein when the primary visual identifier is one of the plurality of colors, the secondary visual identifier is one of the plurality of external shapes or one of the plurality of internal symbols;

assigning each unique icon to one of twelve notes of a musical scale;

wherein the musical scale includes notes arranged into three four-note diminished seventh chords, including a first diminished seventh chord, a second diminished seventh chord, and a third diminished seventh chord;

wherein the musical scale includes notes arranged into four three-note augmented triads, including a first augmented triad, a second augmented triad, a third augmented triad, and a fourth augmented triad;

wherein each of the icons assigned to the notes in the first diminished seventh chord includes a first primary visual identifier that is not included in any of the icons assigned to notes in the second diminished seventh chord and the third diminished seventh chord;

wherein each of the icons assigned to the notes in the second diminished seventh chord includes a second primary visual identifier that is not included in any of the icons assigned to notes in the first diminished seventh chord and the third diminished seventh chord;

wherein each of the icons assigned to the notes in the third diminished seventh chord includes a third primary visual identifier that is not included in any of the icons assigned to notes in the first diminished seventh chord and the second diminished seventh chord;

wherein each of the icons assigned to the notes in the first augmented triad includes a first secondary visual identifier that is not included in any of the icons assigned to notes in the second augmented triad, the third augmented triad, and the fourth augmented triad;

wherein each of the icons assigned to the notes in the second augmented triad includes a second secondary visual identifier that is not included in any of the icons assigned to notes in the first augmented triad, the third augmented triad, and the fourth augmented triad;

wherein each of the icons assigned to the notes in the third augmented triad includes a third secondary visual identifier that is not included in any of the icons assigned to notes in the first augmented triad, the second augmented triad, and the fourth augmented triad;

wherein each of the icons assigned to the notes in the fourth augmented triad includes a fourth secondary visual identifier that is not included in any of the icons assigned to notes in the first augmented triad, the second augmented triad, and the third augmented triad; and providing a musical notation comprising the plurality of icons.

2. The method of claim 1 in which each of the primary visual identifiers is an external shape and each of the secondary visual identifiers is an internal symbol.

3. The method of claim 2 in which each of the twelve unique icons is a unique color.

4. The method of claim 3 in which the first primary visual identifier is a square shape, the second primary visual identifier is a circle shape, and the third primary visual identifier is a hexagon shape.

5. The method of claim 4 in which the first secondary visual identifier is a crescent, the second secondary visual identifier is a slash, the third secondary visual identifier is a star, and the third secondary visual identifier is a plus symbol.

6. The method of claim 1 in which each of the primary visual identifiers is an internal symbol and each of the secondary visual identifiers is an external shape.

7. The method of claim 6 in which each of the twelve unique icons is a unique color.

8. The method of claim 1 in which the twelve notes of the musical scale comprises C, G, D, A, E, B, F#, $D^{\flat}$, $A^{\flat}$, $E^{\flat}$, $B^{\flat}$, and F.

9. The method of claim 1, wherein the musical notation comprises one of standard sheet music supplemented by incorporating one or more of the plurality of icons, a guitar tablature including one or more of the plurality of icons, and a chord frame including one or more of the plurality of icons.

10. A musical instruction comprising:

a musical notation including twelve unique icons each unique icon assigned to one of twelve notes of a musical scale, each icon including a unique combination of at least two visual identifiers, including a primary visual identifier and a secondary visual identifier; and a set of corresponding icons configured to be applied to a playing surface of an instrument in the location in which the corresponding note is produced;

wherein the primary visual identifier is one of a plurality of external shapes, one of a plurality of internal symbols, or one of a plurality of colors;

wherein the secondary visual identifier is one of the plurality of external shapes, one of the plurality of internal symbols, or one of the plurality of colors;

wherein when the primary visual identifier is one of the plurality of external shapes, the secondary visual identifier is one of the plurality of internal symbols or one of the plurality of colors;

wherein when the primary visual identifier is one of the plurality of internal symbols, the secondary visual identifier is one of the plurality of external shapes or one of the plurality of colors;

wherein when the primary visual identifier is one of the plurality of colors, the secondary visual identifier is one of the plurality of external shapes or one of the plurality of internal symbols;

wherein the musical scale includes notes arranged into three four-note diminished seventh chords, including a first diminished seventh chord, a second diminished seventh chord, and a third diminished seventh chord;

wherein the musical scale includes notes arranged into four three-note augmented triads, including a first augmented triad, a second augmented triad, a third augmented triad, and a fourth augmented triad;

wherein each of the icons assigned to the notes in the first diminished seventh chord includes a first primary visual identifier that is not included in any of the icons assigned to notes in the second diminished seventh chord and the third diminished seventh chord;

wherein each of the icons assigned to the notes in the second diminished seventh chord includes a second primary visual identifier that is not included in any of the icons assigned to notes in the first diminished seventh chord and the third diminished seventh chord;

wherein each of the icons assigned to the notes in the third diminished seventh chord includes a third primary visual identifier that is not included in any of the icons assigned to notes in the first diminished seventh chord and the second diminished seventh chord;

wherein each of the icons assigned to the notes in the first augmented triad includes a first secondary visual identifier that is not included in any of the icons assigned to notes in the second augmented triad, the third augmented triad, and the fourth augmented triad;

wherein each of the icons assigned to the notes in the second augmented triad includes a second secondary visual identifier that is not included in any of the icons assigned to notes in the first augmented triad, the third augmented triad, and the fourth augmented triad;

wherein each of the icons assigned to the notes in the third augmented triad includes a third secondary visual identifier that is not included in any of the icons assigned to notes in the first augmented triad, the second augmented triad, and the fourth augmented triad;

wherein each of the icons assigned to the notes in the fourth augmented triad includes a fourth secondary visual identifier that is not included in any of the icons assigned to notes in the first augmented triad, the second augmented triad, and the third augmented triad.

11. The musical instruction of claim 10 in which the instrument is a stringed instrument and the playing surface is a fretboard of the stringed instrument.

12. The musical instruction of claim 10 in which the instrument is a keyboard instrument and the playing surface comprises keys of the keyboard instrument.

13. The musical instruction of claim 10 in which the musical notation comprises one of standard sheet music supplemented by incorporating one or more of the plurality of icons, a guitar tablature including one or more of the plurality of icons, and a chord frame including one or more of the plurality of icons.

14. A method of notating music comprising the steps of:

providing twelve unique icons, each icon including a unique combination of at least two visual identifiers;

assigning each unique icon to one of twelve notes of a musical scale; and providing a musical notation comprising the plurality of icons;

wherein the scale includes three four-note diminished seventh chords and four three-note augmented triads; each of the icons assigned to the notes in each diminished seventh chord includes one of the visual identifiers that only appears in the icons of the notes in the specific diminished seventh chord and not in any of the icons assigned to notes in any of the other diminished seventh chords; and each of the icons assigned to the notes in each augmented triad includes a visual identifier that only appears in each of the icons of the notes in the specific augmented triad and not in any of the icons assigned to notes in any of the other augmented triads.

15. The method of claim 14, wherein the visual identifiers are each one of a plurality of external shapes, one of a plurality of internal symbols, or one of a plurality of colors.

16. The method of claim 15 in which, within a set of primary visual identifiers, each of the primary visual identifiers is an external shape and, within a set of secondary visual identifiers, each of the secondary visual identifiers is an internal symbol.

17. The method of claim 16 in which each of the twelve unique icons is a unique color.

18. The method of claim 17 in which a first primary visual identifier is a square shape, a second primary visual identifier is a circle shape, and a third primary visual identifier is a hexagon shape.

19. The method of claim 18 in which a first secondary visual identifier is a crescent, a second secondary visual identifier is a slash, a third secondary visual identifier is a star, and a third secondary visual identifier is a plus symbol.

20. The method of claim 14 in which each of a set of primary visual identifiers is an internal symbol and each of a set of secondary visual identifiers is an external shape.

* * * * *